US009330873B2

(12) United States Patent
Lee

(10) Patent No.: US 9,330,873 B2
(45) Date of Patent: May 3, 2016

(54) ELECTROMAGNETIC SWITCHING DEVICE

(71) Applicant: LSIS CO., LTD., Anyang-si, Gyeonggi-do (KR)

(72) Inventor: Sang Jin Lee, Daegu (KR)

(73) Assignee: LSIS CO., LTD., Anyang-si (KR)

( * ) Notice: Subject to any disclaimer, the term of this patent is extended or adjusted under 35 U.S.C. 154(b) by 0 days.

(21) Appl. No.: 14/078,345

(22) Filed: Nov. 12, 2013

(65) Prior Publication Data

US 2014/0232493 A1 Aug. 21, 2014

(30) Foreign Application Priority Data

Feb. 18, 2013 (KR) ..... 10-2013-0017221

(51) Int. Cl.

| | |
|---|---|
| ***H01H 67/02*** | (2006.01) |
| ***H01H 50/56*** | (2006.01) |
| ***H01H 50/18*** | (2006.01) |
| ***H01H 50/30*** | (2006.01) |
| *H01H 50/34* | (2006.01) |

(52) U.S. Cl.

CPC ..... *H01H 50/56* (2013.01); *H01H 50/18* (2013.01); *H01H 50/305* (2013.01); *H01H 50/34* (2013.01)

(58) Field of Classification Search

USPC ..... 335/126, 131

See application file for complete search history.

(56) References Cited

U.S. PATENT DOCUMENTS

| | | | | |
|---|---|---|---|---|
| 2,671,836 | A * | 3/1954 | Anger et al. | 335/261 |
| 2,749,403 | A * | 6/1956 | Horman et al. | 335/126 |
| 7,944,333 | B2 * | 5/2011 | Swartzentruber et al. | 335/202 |
| 8,138,863 | B2 * | 3/2012 | Tanaka et al. | 335/195 |
| 8,179,217 | B2 * | 5/2012 | Kawaguchi et al. | 335/80 |
| 8,344,832 | B2 * | 1/2013 | Lee | 335/126 |
| 8,912,871 | B2 * | 12/2014 | Lauraire et al. | 335/229 |
| 2002/0158727 | A1 * | 10/2002 | Namen | 335/78 |

(Continued)

FOREIGN PATENT DOCUMENTS

| | | |
|---|---|---|
| CN | 102456511 | 5/2012 |
| DE | 10360446 | 7/2004 |

(Continued)

OTHER PUBLICATIONS

European Patent Office Application Serial No. 13191543.1, Search Report dated May 9, 2014, 7 pages.

(Continued)

*Primary Examiner* — Alexander Talpalatski

(74) *Attorney, Agent, or Firm* — Lee, Hong, Degerman, Kang & Waimey; Jonathan Kang; Richard Salfelder

(57) ABSTRACT

Disclosed is an electromagnetic switching device. The electromagnetic switching device includes a housing, a fixed contact point inside the housing, a movable contact point positioned under the fixed contact point to repeatedly perform contact with the fixed contact point and separation from the fixed contact point, a shaft coupled with the movable contact point, a return spring to continuously press the shaft downward, and a movable core coupled with the shaft. The shaft includes a pressing surface directed downward, and the movable core is provided to make contact with an upper end of the pressing surface, so that the movable core presses the pressing surface to move up the pressing surface if the movable core and the shaft move up, and the pressing surface presses the movable core downward to push down the movable core if the movable core and the shaft move down.

11 Claims, 4 Drawing Sheets

(56) References Cited

U.S. PATENT DOCUMENTS

| | | | | |
|---|---|---|---|---|
| 2006/0135002 | A1* | 6/2006 | Imanishi et al. | 439/793 |
| 2012/0092094 | A1* | 4/2012 | Lee | 335/78 |

FOREIGN PATENT DOCUMENTS

| | | |
|---|---|---|
| JP | 50-85763 | 12/1952 |
| JP | 06-124636 | 5/1994 |
| JP | 2004-207134 | 7/2004 |
| JP | 2012-089484 | 5/2012 |
| KR | 10-1086908 | 11/2011 |
| KR | 10-1090501 | 12/2011 |
| KR | 1020120039214 | 4/2012 |
| KR | 10-1357084 | 2/2014 |

OTHER PUBLICATIONS

Korean Intellectual Property Office Application Serial No. 10-2013-0017221, Notice of Allowance dated Jun. 20, 2014, 2 pages.

Japan Patent Office Application Serial No. 2013-219996, Office Action dated Aug. 12, 2014, 2 pages.

Korean Intellectual Property Office Application Serial No. 10-2013-0017221, Office Action dated Apr. 15, 2014, 5 pages.

Japan Patent Office Application Serial No. 2013-219996, Office Action dated May 12, 2015, 3 pages.

The State Intellectual Property Office of the People's Republic of China Application Serial No. 201310646700.3, Office Action dated Jul. 13, 2015, 8 pages.

* cited by examiner

ELECTROMAGNETIC SWITCHING DEVICE

CROSS-REFERENCE TO RELATED APPLICATION(S)

Pursuant to 35 U.S.C. §119(a), this application claims the benefit of earlier filing date and right of priority to Korean Application No. 10-2013-0017221, filed on Feb. 18, 2013, the contents of which is incorporated by reference herein in its entirety.

BACKGROUND

The embodiment relates to an electromagnetic switching device. In more particular, the embodiment relates to an electromagnetic switching device capable of improving the endurance by improving the structure of an actuating part.

An electromagnetic switching device is an electric switch device serving as a connection converter to switch on/off a main circuit according to tiny variation of an input current. In the electromagnetic switching device, a contact point is moved by electromagnetic force so that the current is applied or shut off.

FIG. 1 is a sectional view showing a portion of an electromagnetic switching device according to the related art.

A fixed core 5 and a movable core 7, which have hollow structures, are vertically provided in a yoke 4 while being spaced apart from each other, and are pressed in opposition directions to each other by a return spring 8 interposed between the fixed core 5 and the movable core 7.

A shaft 6 is inserted into the centers of the fixed core 5 and the movable core 7. In this case, the shaft 6 is coupled with the movable core 7 by welding a lower end of the shaft 6 with a lower end of the movable core 7. The welded part between the shaft 6 and the movable core 7 is marked in FIG. 1.

In addition, a coil 9 is wound around outer portions of the fixed core 240 and the movable core 7.

Meanwhile, a movable contact point 2 is coupled near an upper end of the shaft 6 above the yoke 210. In addition, a fixed contact point 1 is placed above the movable contact point 2 while being spaced apart from the movable contact point 2.

In addition, the movable contact point 2 is pressed upward by the wipe spring 3, so that the movable contact point 2 may make contact with the fixed contact point 1 at a predetermined pressure.

If a current is applied to the coil 9 under the above structure, the movable core 7 moves upward, so that the shaft 6 coupled with the movable core 7 moves upward. Accordingly, the movable contact point 2 coupled with the shaft 6 makes contact with the fixed contact point 1.

The ascending of the shaft 6 is primarily restricted through the contact between the movable contact point 2 and the fixed contact point 1. However, the ascending force applied to the movable core 7 still remains at the moment in which the movable contact point 2 makes contact with the fixed point 1. A portion of the ascending force is absorbed by the return spring 8, and, finally, the ascending of the shaft 6 and the movable core 7 is terminated due to the collision of the fixed core 5 and the movable core 7.

In this process, the repulse force by the return spring 8 and the impact caused by the collision of the fixed core 5 and the movable core 7 are applied to the welded part between the movable core 7 and the shaft 6.

If the above process is continuously repeated, the welded part may be damaged more rapidly than an expected lifespan.

SUMMARY

The embodiment provides an electromagnetic switching device capable of improving endurance without being broken.

According to the embodiment, there is provided an electromagnetic switching device. The electromagnetic switching device includes a housing, a fixed contact point inside the housing, a movable contact point positioned under the fixed contact point to repeatedly perform contact with the fixed contact point and separation from the fixed contact point, a shaft coupled with the movable contact point, a return spring to continuously press the shaft downward, and a movable core coupled with the shaft. The shaft includes a pressing surface directed downward, and the movable core is provided to make contact with an upper end of the pressing surface, so that the movable core presses the pressing surface to move up the pressing surface if the movable core and the shaft move up, and the pressing surface presses the movable core downward to push down the movable core if the movable core and the shaft move down.

The shaft may include a large diameter portion having a larger outer diameter and a small diameter portion having a smaller diameter portion having a smaller outer diameter under the large diameter portion, and the pressuring surface may be a stepped surface formed at a boundary between the large diameter portion and the small diameter portion.

The shaft may be provided at an upper portion thereof with a return spring receiving part opened upward, and a lower end of the return spring may be received in the return spring receiving part to continuously press the shaft downward.

The shaft may be provided at an inner hollow region thereof with a wipe spring receiving part, and a wipe spring may be received in the wipe spring receiving part to press the movable contact point upward.

The wipe spring receiving part may include a cutting part vertically extending.

The movable contact point may constitute a movable contact that reciprocates up and down through the cutting part.

The electromagnetic switching device may further include an upper fixed part provided at an inner upper portion of the housing, and the upper fixed part may include an ascending limiter to make contact with the shaft to limit the movement-up of the shaft.

The upper fixed part may include a return spring coupling part, and the ascending limiter may be a plane directed downward outside the return spring coupling part while horizontally extending.

A guide part extending downward may be provided outside the ascending limiter.

The electromagnetic switching may further include a bobbin provided outside a fixed core, and the bobbin may include a protrusion protruding toward an inner hollow part, and the fixed core may be positioned above the protrusion.

An inner end portion of the protrusion may be positioned beyond an inner lateral side of the fixed core.

According to the embodiment, the electromagnetic switching device may further include an elastic member coupled with a lower portion of the shaft, and an upper portion of the elastic member may be at least partially inserted into the movable core.

An outer lateral side of the elastic member may be stepped, and the stepped portion of the elastic member may make contact with a bottom surface of the movable core.

As described above, according to the present invention, a welding work is not required between the movable core and the shaft. In addition, even though the shaft and the movable core repeatedly move up and down, the parts may not be broken, so that the endurance can be improved.

DETAILED DESCRIPTION OF THE EMBODIMENTS

Figure 1:
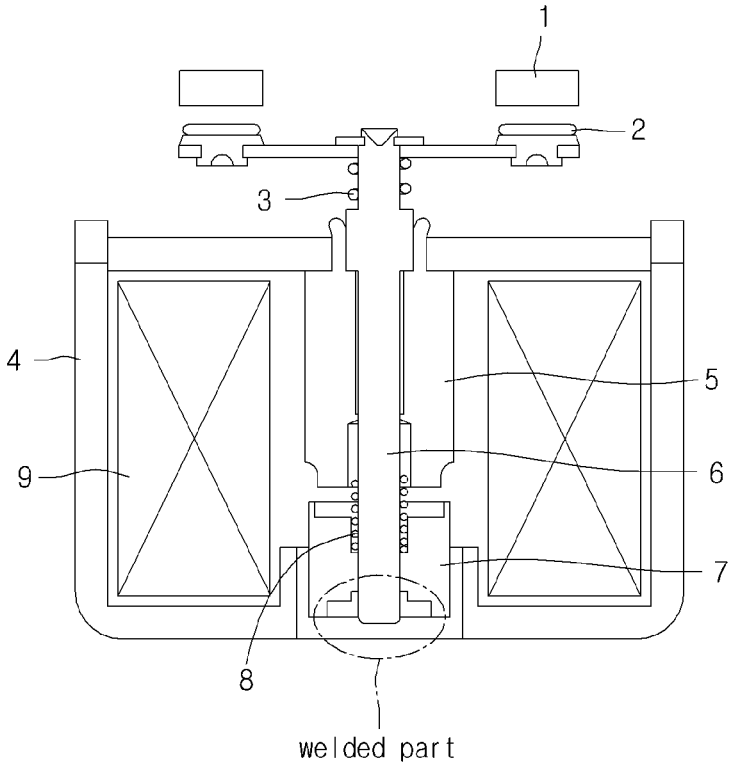
FIG. 1 is a sectional view showing a portion of an electromagnetic switching device according to the related art.
Figure 2:
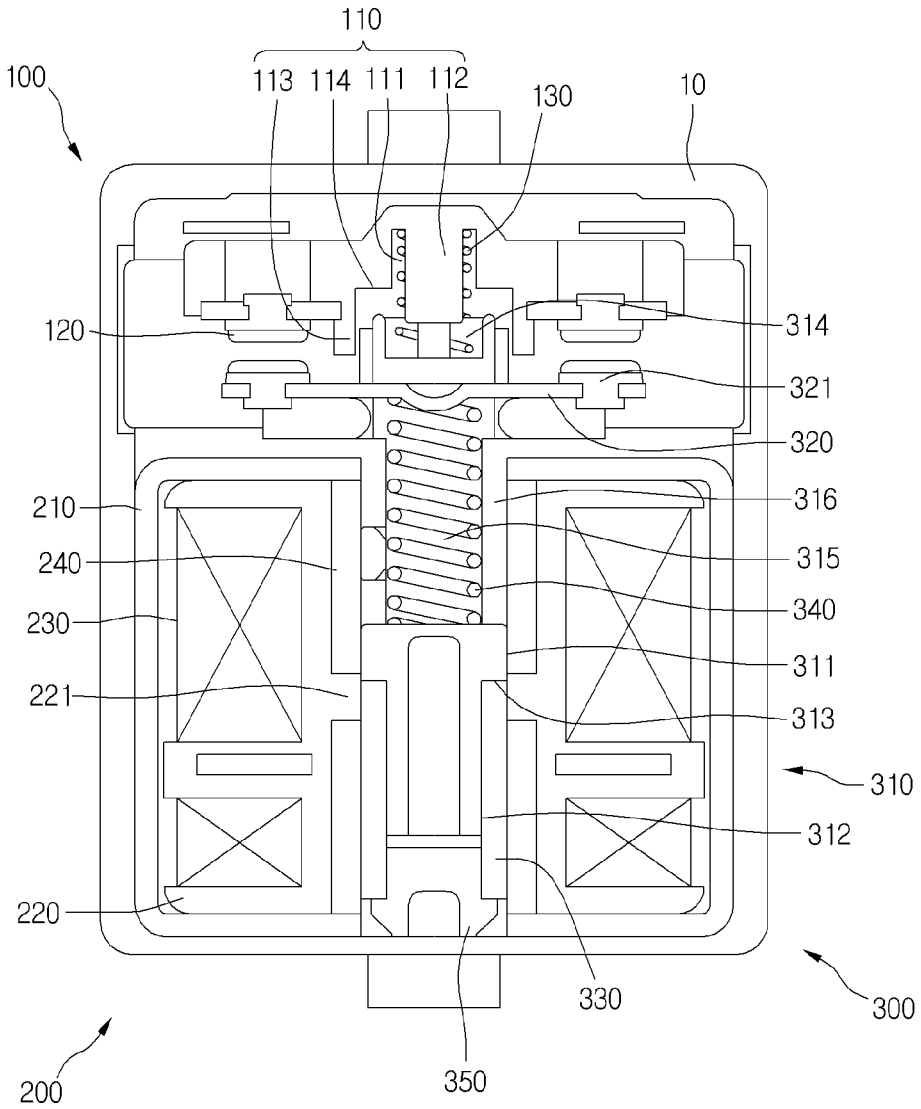
FIG. 2 is a sectional view showing the ascending of the actuating part in the electromagnetic switching device according to one embodiment.

Hereinafter, an electromagnetic switching device according to the embodiment will be described with reference to accompanying drawings in detail.

The electromagnetic switching device according to the embodiment includes a housing 10, an upper assembly 100 placed at an upper portion in the housing 10, and lower assemblies 200 and 300 placed at a lower portion in the housing 10.

The housing 10 surrounds an outmost portion of the electromagnetic switching device according to the embodiment and receives the upper assembly 100 and the lower assemblies 200 and 300 therein.

Hereinafter, the structure of the upper assembly 100 will be primarily described and then the structure of the lower assemblies 200 and 300 will be described.

The upper assembly 100 includes an upper fixed part 110, a fixed contact point 120, and a return spring 130.

The upper fixed part 110 includes a return spring coupling part 111, a return spring coupling protrusion 112, a guide part 113, and an intermediate part 114.

The return spring coupling part 111 has a substantially cylindrical groove shape which is open downward. Accordingly, the return spring coupling protrusion 112 having a substantially cylindrical shape protruding downward is provided at the center of the return spring coupling part 111.

The top end of the return spring 130 to be described later is fitted around an outer side of the return spring coupling protrusion 112. That is, the top end of the return spring 130 is fitted around the return spring coupling part 111 having a substantially cylindrical groove shape.

The guide part 113 extending downward is provided at an outer side of the return spring coupling part 111. The guide part 113 receives the top end of the shaft 310 to be described later, and has a shape corresponding to the top end of the shaft 310 so that the top end of the shaft 310 may slide up and down inside the guide part 113.

Meanwhile, the intermediate part 114, which is a plane facing downward, is provided between the guide part 113 and the return spring coupling part 111. The intermediate part 114 makes contact with the top end of the shaft 310 as the shaft 310 moves up so that the intermediate part 114 may serve as a limiter for limiting the upward movement of the shaft 310. In the embodiment, the limiter signifies a configuration making contact with the shaft 310 to prevent the shaft 310 from moving up any more.

Accordingly, if the return spring coupling protrusion 112 extends downward such that the bottom end of the return spring coupling protrusion 112 makes contact with a bottom surface of a return spring receiving part 314 of the shaft 310 before the top end of the shaft 310 makes contact with the intermediate part 114, the return spring coupling protrusion 112 may serve as the limiter.

The fixed contact point 120 is placed at an outer side of the upper fixed part 110. The fixed contact point 120 includes a conductive material.

As described above, the top end of the return spring 130 is fitted around the return spring coupling part 111, and the bottom end of the return spring 130 is supported by the return spring receiving part 314 in the shaft 310 to be described later so that the return spring 130 can always press the shaft 310 downward.

Hereinafter, a configuration of the lower assemblies 200 and 300 disposed under the upper assembly 100 will be described.

The lower assemblies 200 and 300 include a driving part 200 to provide a driving force according to a current applied from the outside and an actuating part 300 moving up and down according to the driving force from the driving part 200.

First, a configuration of the driving part 200 will be described. The driving part 200 according to the embodiment includes a yoke 210, a bobbin 220 provided in the yoke 210, a coil 230 wound around the bobbin 220, and a fixed core 240 coupled with an inner peripheral surface of the bobbin 220.

The yoke 210 is received in the housing 10, and the bobbin 220 is placed at an inner side of the yoke 210.

The coil 230 is wound around the bobbin 220 and the bobbin 220 includes a protrusion 221 with an intermediate part having a substantially hollow cylindrical shape and protruding from a longitudinal center point to an inner hollow part.

As described above, the coil 230 is wound around an outer side of the bobbin 220 and generates a driving force to ascend the actuating part 300 by generating a magnetic force according to an electrical signal.

Fixed cores 240 are coupled with an inner side of the bobbin 220. The fixed core 240 has a substantially hollow cylindrical shape, and provided at upper and lower portions based on the protrusion 221. Accordingly, the lower end of the fixed core 240 provided at the upper portion of the protrusion 221 makes contact with the top surface of the protrusion 221, and the upper end of the fixed core 240 placed at the lower portion of the protrusion 221 makes contact with the bottom surface of the protrusion 221.

In this case, an inner end of the protrusion of the bobbin 220 is aligned on the same line with an inner side of the fixed core 240 or located inward of the inner side of the fixed core 240. That is, the protrusion 221 protrudes corresponding to or more than the thickness of the fixed core 240.

Hereinafter, a configuration of the actuating part 300 will be described.

The actuating part 300 includes a shaft 310 that reciprocates up and down, a movable contact 320 coupled with the shaft 310 and including a movable contact point 321, a movable core 330, a wipe spring 340, and an elastic member 350.

The shaft 310 is disposed at a hollow region inside the fixed core 240, and has a substantially cylindrical shape extending up and down.

An outer diameter of an upper part of the shaft 310 is greater than an outer diameter of a lower part of the shaft 310, and a stepped surface facing downward is formed at the part where the outer diameter varies. Accordingly, an upper portion becomes a large diameter portion 311, and a lower portion becomes a small diameter portion 312 based on the stepped surface. The stepped surface becomes a pressing surface 313 making contact with an upper end of the movable core 330 to be described later.

Meanwhile, the top end of the shaft 310 is open, a hollow region having a predetermined depth is formed downward from the top end and the hollow region forms a return spring receiving part 314.

A bottom end of the return spring 130 described above is received and supported in the return spring receiving part 314.

Meanwhile, another hollow region is formed below a bottom surface of the return spring receiving part 314, and the another hollow region becomes a wipe spring receiving part 315. The wipe spring receiving part 315 is formed at an inner side of the large diameter portion 311.

A wipe spring 340 is received in the wipe spring receiving part 315.

Figure 3:
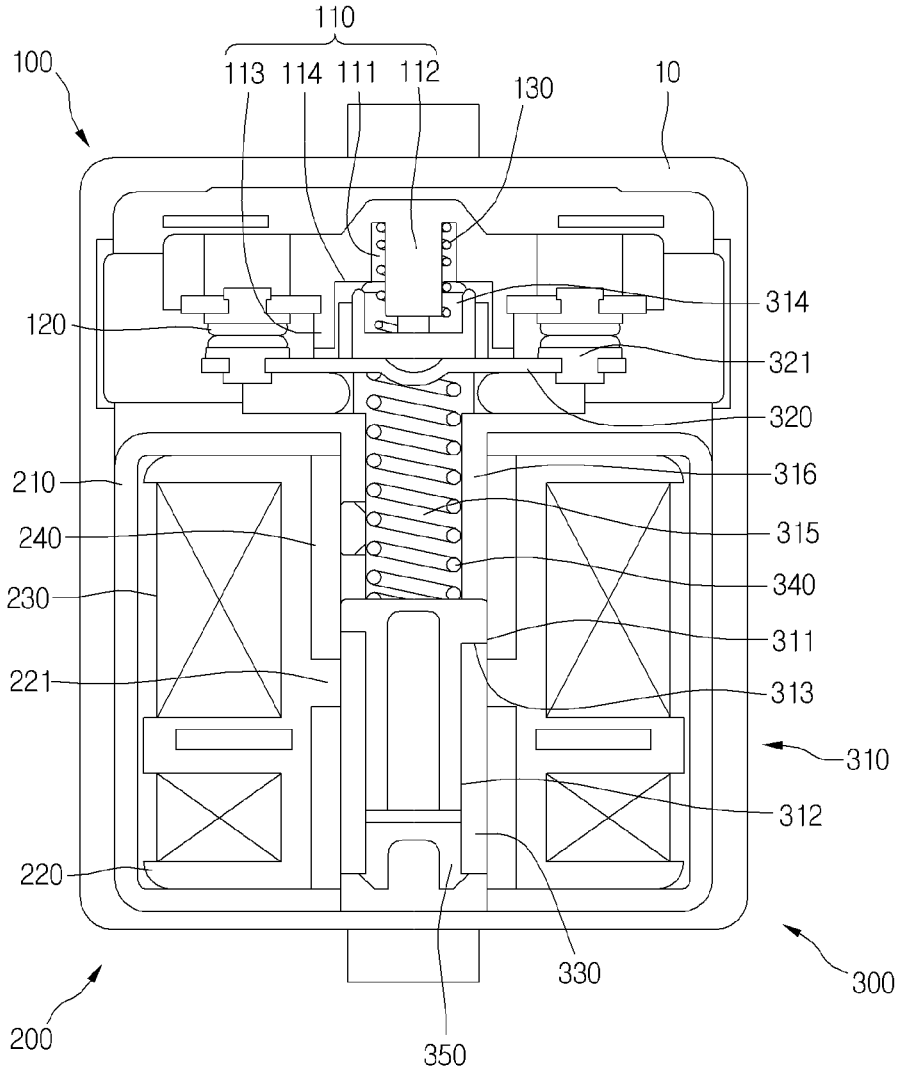
FIG. 3 is a sectional view showing the descending of the actuating part in the electromagnetic switching device according to one embodiment.
Figure 4:
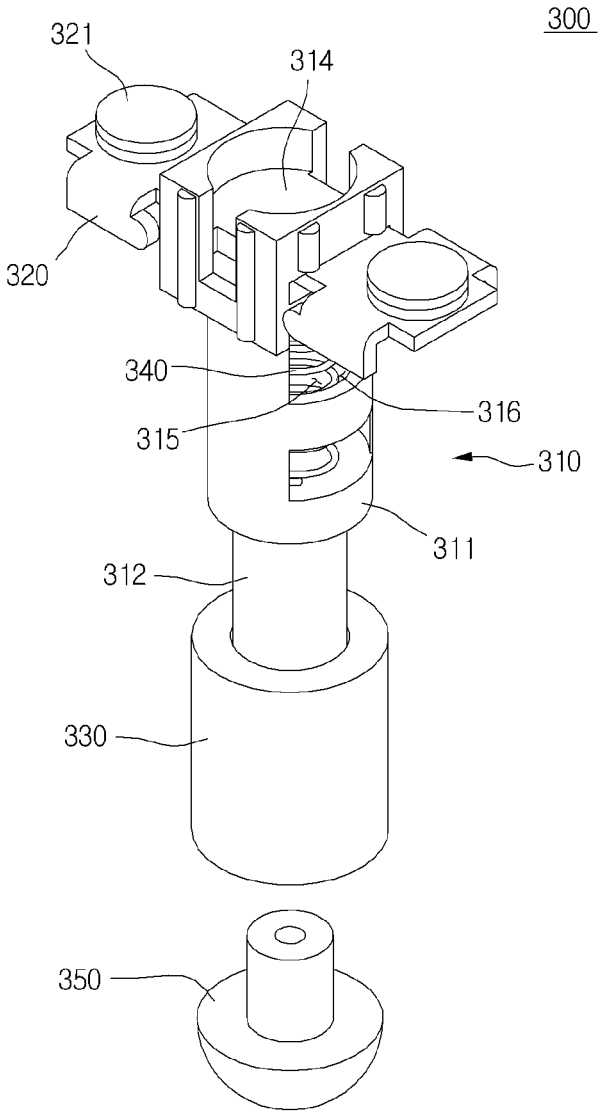
FIG. 4 is a perspective view showing only the actuating part.

A lateral side of the wipe spring receiving part 315 is partially incised in the length direction so that a cutting part 316 is formed as shown FIGS. 3 to 4. A pair of cutting parts 316 are provided while facing each other.

The cutting part 316 serves as a space in which the movable contact 320 may move up and down.

The movable contact 320 is a conductor having a flat plate shape and the movable contact point 321 is provided thereon. The movable contact 320 may be formed integrally with the movable contact point 321. The movable contact 320 extends by passing through the shaft 310 via the cutting part 316 and the movable contact point 321 is positioned below the fixed contact point 120 to repeatedly make contact with the fixed contact point 120.

The movable contact 320 makes contact with the top end of the wipe spring 340, and is always pressed upward by the wipe spring 340.

The movable core 330 is coupled with an outer side of the small diameter portion 312 of the shaft 310.

A top end of the movable core 330 makes contact with the pressing surface 313. Since the movable core 330 slides in the fixed core 240, an outer diameter of the movable core 330 must be smaller than an inner diameter of the fixed core 240. The outer diameter of the movable core 330 is substantially the same as the outer diameter of the large diameter portion 311.

Accordingly, the small diameter portion 312 becomes a movable core coupling part. Hereinafter, the small diameter portion and the movable core coupling part will be denoted with the same reference numeral 222. That is, reference numeral 222 may refer to the small diameter portion 312 distinguished from the large diameter portion 311, and may refer to the movable core coupling part coupled with the movable core 330.

The elastic member 350 is coupled with a lower end of the shaft 310. When the movable part 300 descends, the elastic member 350 absorbs shock with a bottom surface of the housing 10.

The elastic member 350 is stepped at an outer side thereof. The stepped portion of the elastic member 350 makes contact with the bottom surface of the movable core 330. In addition, an upper portion of the elastic member 350 is partially inserted into the movable core 330.

Meanwhile, the elastic member 350 preferably has asymmetric bottom surfaces. Upon ascending and descending, the elastic member 350 doe not perpendicularly move up and down, but ascend and descend while colliding with an inner side of the fixed core 240 to the left and right. Although it may rarely happen, the shaft 310 may perpendicularly move down exactly.

In this case, since the bottom end of the shaft 310 collides with the bottom surface of the housing 10 so that the bottom end of the shaft 310 is perpendicularly bounced again, a strong ascending force may be generated due to a repulsive force so the fixed contact point 120 may unintentionally make contact with the movable contact point 321.

Accordingly, the bottom end of the elastic member 350 are asymmetrically formed. In this case, when the shaft 310 perpendicularly moves down exactly, the shaft 310 does not perpendicularly move up exactly, but collide with a side of the fixed core 240 to the left and right while moving up, so that the ascending speed of the shaft 310 may be reduced.

Hereinafter, an operation of the electromagnetic switching device having a structure as mentioned above will be described.

The shaft 310 is always pressed downward, that is, in a direction in which the fixed contact point 120 is away from the movable contact point 321 so that the fixed contact point 120 is spaced apart from the movable contact point 321.

In this state, if a current is applied to the coil 230, the movable core 330 has a driving force to move up and down due to a magnetic flux generated by the coil 230.

The movable core 330 ascends due to the driving force. The move core 330 ascends while pressing the pressing surface 313 of the shaft 310 upward to ascend the shaft 310.

If the shaft 310 ascends, the movable contact point 321 makes contact with the fixed contact point 120. After the movable contact point 321 makes contact with the fixed contact point 120, the shaft 310 further ascends and the upper end of the shaft 310 makes contact with the intermediate part 114, so that the ascending of the shaft 310 is terminated.

In this case, since the wipe spring 340 continuously presses the movable contact 320 upward, the movable contact point 321 may make contact with the fixed contact point 120 at a predetermined pressure or more.

Meanwhile, if power supply to the coil 230 is shut off, the shaft 310 moves down due to an elasticity force of the return spring 130.

Through the above operation, when the upper end of the shaft 310 collides with the intermediate part 114 (upward-movement limiter) as the shaft 310 ascends, or when the shaft 310 is pressed downward by the return spring 130 in order to descend the shaft 310, the force applied to the shaft 310 is delivered to the movable core 330 through the pressing surface 313.

In other words, when comparing with the related art shown in FIG. 1 in which, conventionally, the return spring presses only the movable core 330, and the movable core 330 makes contact with the fixed core 240 to stop so that the welded part between the movable core 330 and the shaft 310 may be easily broken, the embodiment has a structure in which the return spring 130 presses the shaft 310, and the shaft 310 presses the top surface of the movable core 330 downward to move down the movable core 330, thereby preventing parts from being broken in the process of delivering force.

What is claimed is:

1. An electromagnetic switching device comprising:

a housing;

a fixed contact point inside the housing;

a movable contact including a movable contact point positioned under the fixed contact point to repeatedly contact with the fixed contact point and separate from the fixed contact point;

a shaft comprising a return spring receiving part coupled to the movable contact, a wipe spring receiving part coupled beneath the movable contact, and a pressing surface directed downward and located below the wipe spring receiving part;

a return spring mounted in the return spring receiving part to continuously press the shaft downward;

a wipe spring mounted in the wipe spring receiving part to continuously press the movable contact point upward;

a fixed core inside the housing, the fixed core including a hollow region receiving the wipe spring receiving part and the pressing surface;

a movable core located such that a top end of the movable core contacts the pressing surface, the movable core movable up and down according to a mutual electromagnetic force of the fixed core and the movable core; and an elastic member coupled with a lower portion of the shaft, an upper portion of the elastic member at least partially inserted into the movable core and a bottom surface of the elastic member asymmetrically formed, wherein the shaft comprises an open top end such that a hollow region is formed within the shaft to a predetermined depth;

wherein the wipe spring receiving part is located in the hollow region of the shaft such that the wipe spring extends into the hollow region of the shaft, wherein the movable core presses the pressing surface upward when the movable core and the shaft move upward, and wherein the pressing surface presses the movable core downward when the movable core and the shaft move downward.

2. The electromagnetic switching device of claim 1, wherein:

the shaft further comprises a first portion having a first outer diameter beneath the return spring receiving part and a second portion having a second outer diameter beneath the first portion, the first outer diameter larger than the second outer diameter; and the pressuring surface is a stepped surface formed at a boundary between the first portion and the second portion.

3. The electromagnetic switching device of claim 1, wherein the wipe spring receiving part comprises a vertically extending cutting part.

4. The electromagnetic switching device of claim 3, wherein the movable contact point moves up and down through the cutting part.

5. The electromagnetic switching device of claim 1, further comprising an upper fixed part provided at an inner upper portion of the housing, the upper fixed part comprising an ascending limiter contacting the shaft to limit upward movement of the shaft.

6. The electromagnetic switching device of claim 5, wherein:

the upper fixed part further comprises a return spring coupling part; and the ascending limiter is a horizontally extending plane directed downward outside the return spring coupling part.

7. The electromagnetic switching device of claim 5, further comprising a guide part extending downward outside the ascending limiter.

8. The electromagnetic switching device of claim 1, further comprising a bobbin provided outside the fixed core, the bobbin comprising a protrusion protruding toward the hollow region of the fixed core and the fixed core positioned above the protrusion.

9. The electromagnetic switching device of claim 8, wherein an inner end portion of the protrusion is positioned beyond an inner lateral side of the fixed core.

10. The electromagnetic switching device of claim 1, wherein the shaft is configured to move perpendicularly downward but not perpendicularly upward such that the shaft collides with a side of the fixed core when moving upward in order to reduce an upward speed of the shaft.

11. The electromagnetic switching device of claim 10, wherein:

an outer lateral side of the elastic member comprises a stepped portion; and the stepped portion contacts a bottom surface of the movable core.

* * * * *